US007112092B2

(12) United States Patent
Vielhaber et al.

(10) Patent No.: US 7,112,092 B2
(45) **Date of Patent: *Sep. 26, 2006**

(54) COAXIAL CABLE COUPLER, ESPECIALLY AN ANTENNA COUPLER

(75) Inventors: Rupert Vielhaber, Rochester Hills, MI (US); Helmut Häussler, Aichtal (DE); Olaf Geertsema, Lichtenstein (DE); Ivica Segrt, Deckenpfronn (DE)

(73) Assignee: Hirschmann Electronics GmbH & Co. KG, Neckartenzlingen (DE)

( * ) Notice: This patent issued on a continued prosecution application filed under 37 CFR 1.53(d), and is subject to the twenty year patent term provisions of 35 U.S.C. 154 (a)(2).

Subject to any disclaimer, the term of this patent is extended or adjusted under 35 U.S.C. 154(b) by 72 days.

(21) Appl. No.: 10/821,783

(22) Filed: Apr. 9, 2004

(65) Prior Publication Data

US 2004/0219834 A1 Nov. 4, 2004

(30) Foreign Application Priority Data

Apr. 9, 2003 (DE) ..... 103 16 478

(51) Int. Cl.
*H01R 9/05* (2006.01)

(52) U.S. Cl. ..... 439/578; 439/585

(58) Field of Classification Search ..... 439/578, 439/585, 63, 675
See application file for complete search history.

(56) References Cited

U.S. PATENT DOCUMENTS

| | | | | |
|---|---|---|---|---|
| 3,363,222 | A * | 1/1968 | Karol | 439/581 |
| 3,670,293 | A | 6/1972 | Garver | |
| 3,915,535 | A | 10/1975 | O'Keefe et al. | |
| 3,923,367 | A * | 12/1975 | Carter | 439/585 |
| 5,024,608 | A * | 6/1991 | Heng et al. | 439/578 |
| 5,037,328 | A * | 8/1991 | Karlovich | 439/578 |
| 5,061,206 | A * | 10/1991 | Kawanami et al. | 439/582 |
| 5,957,724 | A * | 9/1999 | Lester | 439/578 |
| 6,607,399 | B1 * | 8/2003 | Endo et al. | 439/578 |
| 6,746,267 | B1 * | 6/2004 | Fukamachi et al. | 439/374 |

FOREIGN PATENT DOCUMENTS

| | | |
|---|---|---|
| FR | 0 450 988 | 8/1991 |
| GB | 1073899 | 9/1965 |

* cited by examiner

*Primary Examiner*—Tho D. Ta
(74) *Attorney, Agent, or Firm*—Andrew Wilford

(57) ABSTRACT

A coupler for a coaxial plug and connectable with a cable, especially an antenna coupler with an outer conductive sleeve comprised entirely or partly of metal and formed by bending from a blank whose basic shape is produced by stamping or punching from steel metal.

9 Claims, 5 Drawing Sheets

COAXIAL CABLE COUPLER, ESPECIALLY AN ANTENNA COUPLER

FIELD OF THE INVENTION

The present invention relates to a coupler for a coaxial plug connector and generally for coaxial wiring, adapted to receive a corresponding plug, and, more particularly, to an antenna coupler which has an outer conductive sleeve engageable with an outer conductive sleeve of a plug.

BACKGROUND OF THE INVENTION

A coupler for coaxial conductors and especially an antenna coupler is described in German patent document DE 196 09 571. In general, this coupler has an outer sleeve which can be cast or machined from metal and is formed with a massive sleeve. It may be made by turning and/or milling and has with its outer side a bulge which can be engaged by a locking element which can fix a plug, receivable in the coupler, and lock them together. The turning or milling of a solid material, like that on which the outer sleeve has been fabricated in the past is expensive and time-consuming.

OBJECTS OF THE INVENTION

It is the principal object of the present invention to provide an improved coupler and especially an improved antenna coupler, which is free from drawbacks of prior art systems.

Another object of this invention is to provide a coupler forming a socket for a plug of a coaxial conductor in which the fabrication of the outer conductive sleeve is simplified.

It is another object of the invention to provide a coupler with an outer conductive sleeve which can be manufactured in a cost-effective manner, which can be mounted automatically or manually, which is service-friendly and which enables replaceability of components should they become damaged.

SUMMARY OF THE INVENTION

These objects and others which will become apparent hereinafter are attained, in accordance with the present invention by providing a coupler whose outer conductive sleeve is formed by plastically deforming a sheet metal blank or strip whose basic shape is imparted to the sheet metal by stamping, punching, cutting or the like and whose sleeve shape is produced by bending.

By eliminating the need for machining a solid body to form the sleeve and by producing the outer conductive sleeve from a plastically-deformable sheet metal blank which initially is shaped by stamping or cutting, it is possible to impart the sleeve shape to the blank exclusively by a bending operation. The stamping of a sheet metal is a far simpler fabrication technique and the bending can be carried out even more simply, thereby affording a substantial saving in the fabrication cost of the coupler.

According to a feature of the invention the outer conductive sleeve is held with an insulating body by a spring ring which can ensure a good and permanent contact with the outer sleeve, shell or casing of the plug inserted therein. The spring ring ensures not only such contact but also precludes bending of the outer conductive sleeve in such fashion that it will loosen on the support onto which that sleeve is applied by the bending operation. The outer conductive sleeve can be retained by additional spring rings at various locations along its length and/or can be secured in place by spot welds which join the opposite edges of the bent blank to each other. Adhesive bonding between these edges or along the same can also be used.

It is also possible for the opposing edges along the seam to have corresponding projections and recesses which can be interengaged to secure these edges together.

Advantageously, apart from the spring ring, the sheet metal sleeve can be provided with recesses, depressions, cutouts or like stamping-produced formations which retain the spring ring in the axial direction. The geometries of these elements should be such that they project outwardly. Where these formations engage the spring ring on one side, the spring ring may be coated on the other by some other member. For example, the edge of the sheet metal sleeve can be flared outwardly to facilitate connection to the plug and the flair, and in this case can serve as a stop for the spring ring. The sheet metal sleeve can also be formed with axially-extending seals to increase its flexibility, especially in the radial direction.

The insulator can have, preferably, a plurality of circumferential external rings but at least one such ring, to serve for radial guidance of the insulator in the outer conductive sleeve or to allow interengagement of at least one bulge-like enlargement of the sheet metal sleeve with a respective ring. The ring and bulge arrangement axially secures the insulator in the outer conductive sleeve. The bulge-like enlargements can be formed in a simple manner by upsetting, rolling or the like as part of the bending operation.

The outer wall of the outer conductive sleeve can have a plurality, preferably two or three bulge-like enlargements, between two of which a constricted holding segment is provided. The outer contour of the outer conductive sleeve can also be formed in a separate process, for example by injection molding. In this case one or more bulges are formed on the sheet metal member by injection molding a plastic thereon.

The outer conductive sleeve can be bent around an insulator, preferably by a bending rolling process whereby the rings or annular shoulders on the insulator can produce the bulges in the outer conductive sleeve with the rings fitted into those bulges. It is also possible to shape the blank into a sleeve by a bending process, for example by rolling and then to insert the insulator in this sleeve axially. The insulator then should have abutments which can cooperate with shoulders in the outer conductive sleeve to position the latter on the insulator. It is also possible to provide the insulator in the outer conductive sleeve by an injection molding process. This can be the same process as that which applies the outer contour of the outer conductive sleeve or a separate step. The insulator can be braced against the cable which is affixed to the outer conductive sleeve, for example by a crimp lug so that the assembly of the coupler to the cable will provide a sleeve and insulator in fixed positions and enable the insertion of the plug so that the conductors of the plug may appropriate electrical contact with the contact elements of the coupler. The cable need not, however, be braced against the insulator if the insulator is form-fitting in the outer conductive sleeve.

In a further feature of the invention, the outer conductive sleeve can be received in a support body which can have a prelocking element and/or a locking slider which can engage behind one or more of the bulges-shaped enlargements. The prelocking element is preferably configured as a wedge-shaped detent which initially locks the outer conductive sleeve when it is inserted in the support body. The locking slider can engage upon further insertion of the outer conductive sleeve in the support body between two of the bulges of the outer conductive sleeve.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
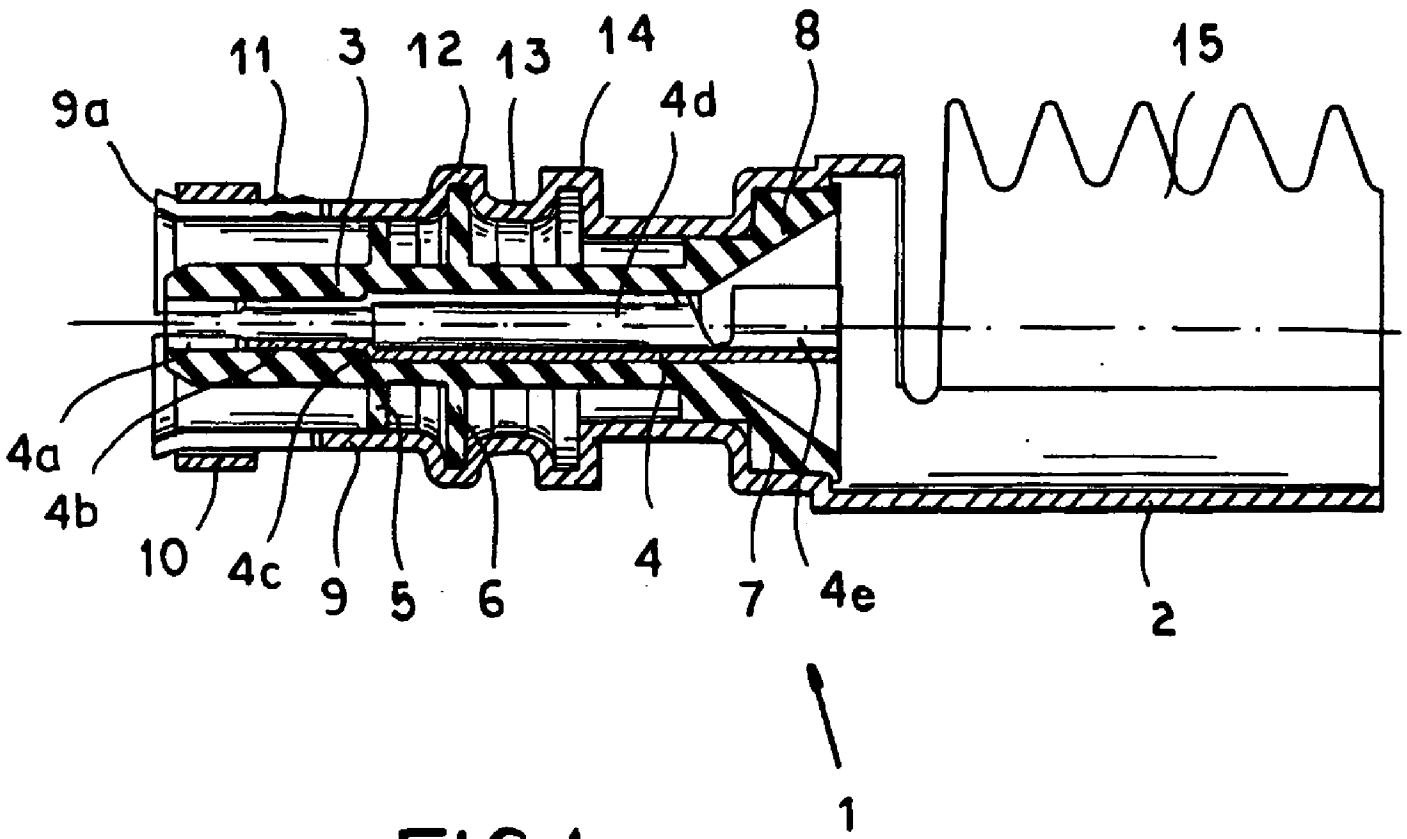
FIG. 1 is a schematic longitudinal section through an antenna coupler according to the invention.

The embodiments shown in FIGS. 1 to 4 all are couplers 1, especially antenna couplers, which comprise an outer conductive sleeve 2, an insulator 3 and a contact element 4 coaxial with the outer conductive sleeve. The contact element 4 may, in turn, be a sleeve formed by a multiplicity of axial tongues 4*a* which are adapted to surround and make electrical contact with a pin of a plug insertable into the coupler. The axially extending tongues 4*a* may be joined to a generally cylindrical portion 4*b* which is connected by a step 4*c* with a cylindrical body portion 4*d* terminating in a lug 4*e* which can be clamped on a core conductor of a coaxial cable whose wire makes electrical contact with the member 4. The member 4, like the outer conductive casing 2 may be bent from sheet metal if desired.

The insulator 3 has two outer rings 5 and 6 as well as a support flange 7. The latter in its interior is formed with a funnel 8 for guiding the core conductor of the coaxial cable (not shown) into the coupler.

The support flange 7 of the insulator has a stepped bore and in that stepped bore, the connector 4 is received.

The outer conductive sleeve 2 has at its end turned toward the plug, which has not been shown but is inserted from the left, a socket sleeve region 9 on which a spring ring 10 is disposed. The spring ring 10 is axially anchored between a widening at the outer lip 9*a* which may be flared to permit insertion of the plug and a hemispherical cup shaped bulge 11 formed in the sleeve region 9. The outer ring 5 of the insulator 3 fits within the outer conductive sleeve 2 and specifically within a bulge-shaped enlargement thereof to axially position that sleeve with respect to the insulator 3. Between the enlargements 12 and 14 of the outer conductive sleeve 2, a retaining constriction 13 is provided to limit relative movement of the sleeve and the insulator axially.

On the end of the sleeve 2 opposite the plug end region 9, a crimp lug 15 is provided which can be clamped on the braid of a coaxial cable. Two crimp lugs 15 can be provided for use selectively depending upon the cable diameter which is used.

The complete outer conductor sleeve in all of the embodiments shown can be stamped, punched, cut or otherwise formed from sheet metal initially as a blank 20 which can have formations corresponding to the crimp lug, tongues 21 in the plug in portion 9, etc. The sheet metal is plastically deformable and bent into a sleeve shape. The bulge shape enlargements 12 and 14 as well as the constriction portion 13 can be provided by appropriate upsetting or rolling of the sheet metal or blank 20. In the embodiment of FIG. 1 the insulator is first inserted in the blank 5 and the blank is then formed around the insulator to the outer conductive sleeve.

Figure 2:
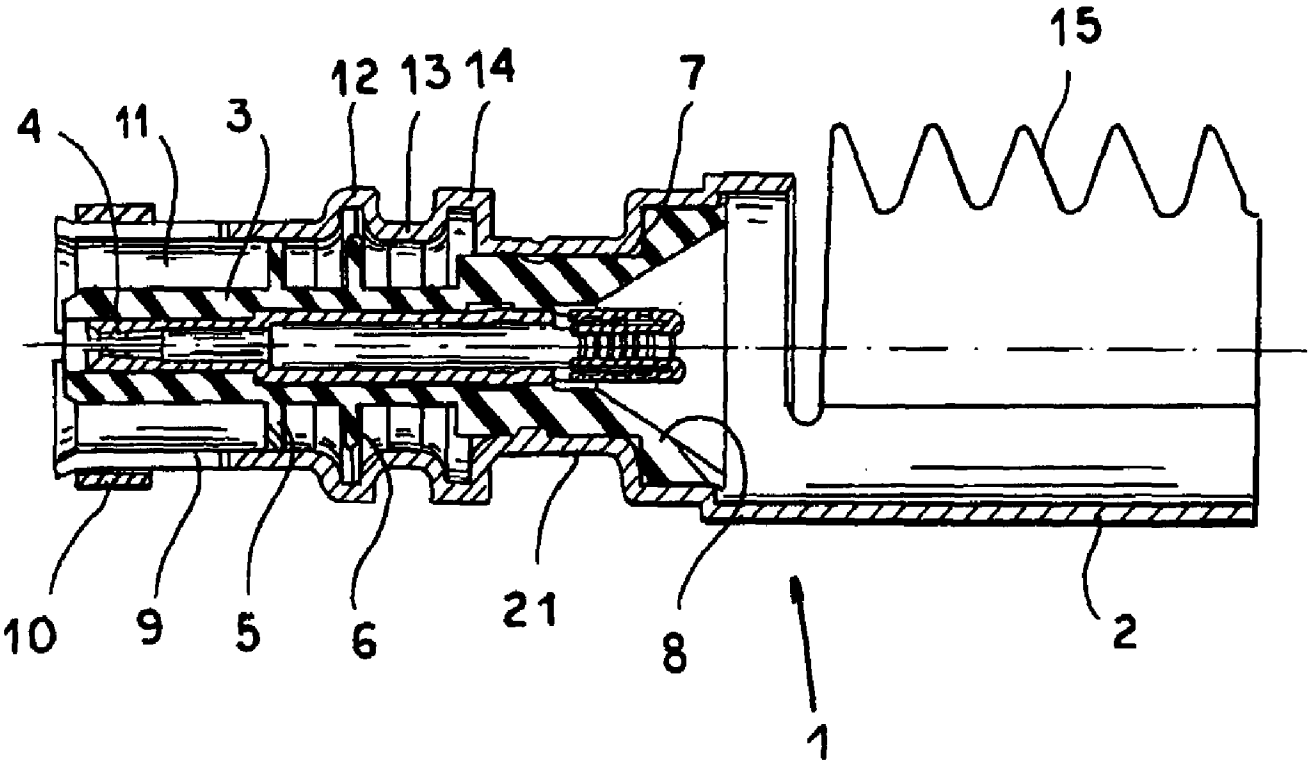
FIG. 2 is a longitudinal section similar to FIG. 1 but showing a modified insulator.
Figure 3:
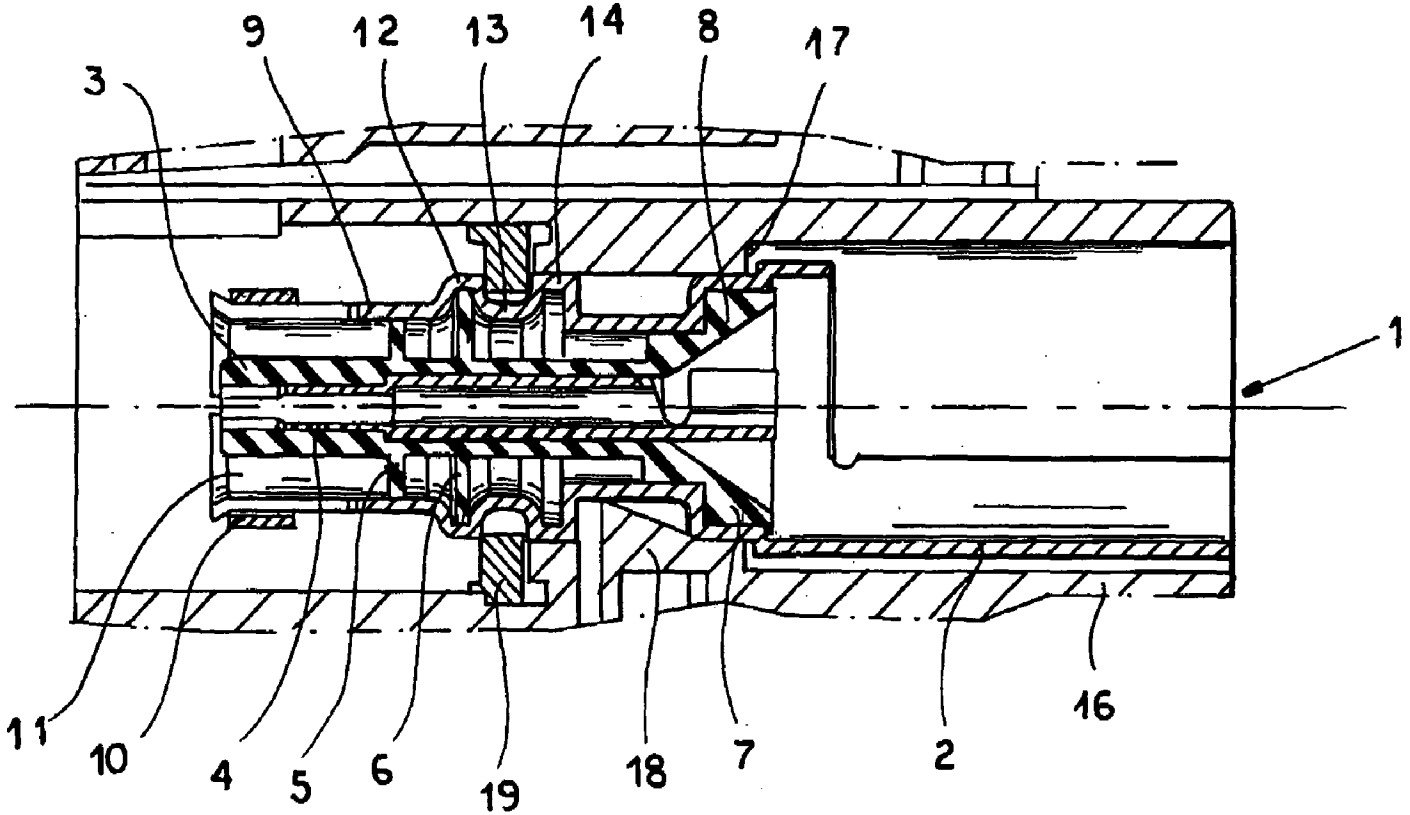
FIG. 3 is a longitudinal section similar to that of FIG. 1 but illustrating an embodiment with a modified outer conductive sleeve and a support body.

In the embodiment of FIG. 2, the insulator is not inserted and the blank is not rolled thereon. Rather the insulator 3 is inserted after the blank has been rolled to the shape of a sleeve. For this purpose, the outer ring 6 of the insulator is made of smaller diameter than that of FIG. 1 so that the insulator can be inserted axially in the preformed outer conductive sleeve and can be anchored in one direction therein by the support flange 7 while in the opposite direction it is braced either by a can be engaged by the crimp lug, for example, coining, embossing, upsetting, cup shaped recesses or adhesive bonding. In the embodiment of FIG. 3, the outer conductive sleeve is supported in a support body 16. By mounting the outer conductive sleeve in the support body 16, the outer conductive sleeve is inserted until it comes against an abutment edge 17. The bulge 12 and the bulge 14 straddle a locking slider 19 after passing over the prelocking element 18, whereupon the slider 19 is locked in the constriction 13. As will be apparent from FIG. 3, the prelocking element 18 engages first and provides a provisional retention of the outer conductive sleeve, the final locking being achieved with the slider 19. The slider 19 can be a lock having an oval opening which then is displaced to fully engage within the recess 13. In the embodiment of FIG. 3 the outer conductive sleeve 2 has no crimp lug since another type of fastening to the cable of the outer connective sleeve is provided here.

Figure 4:
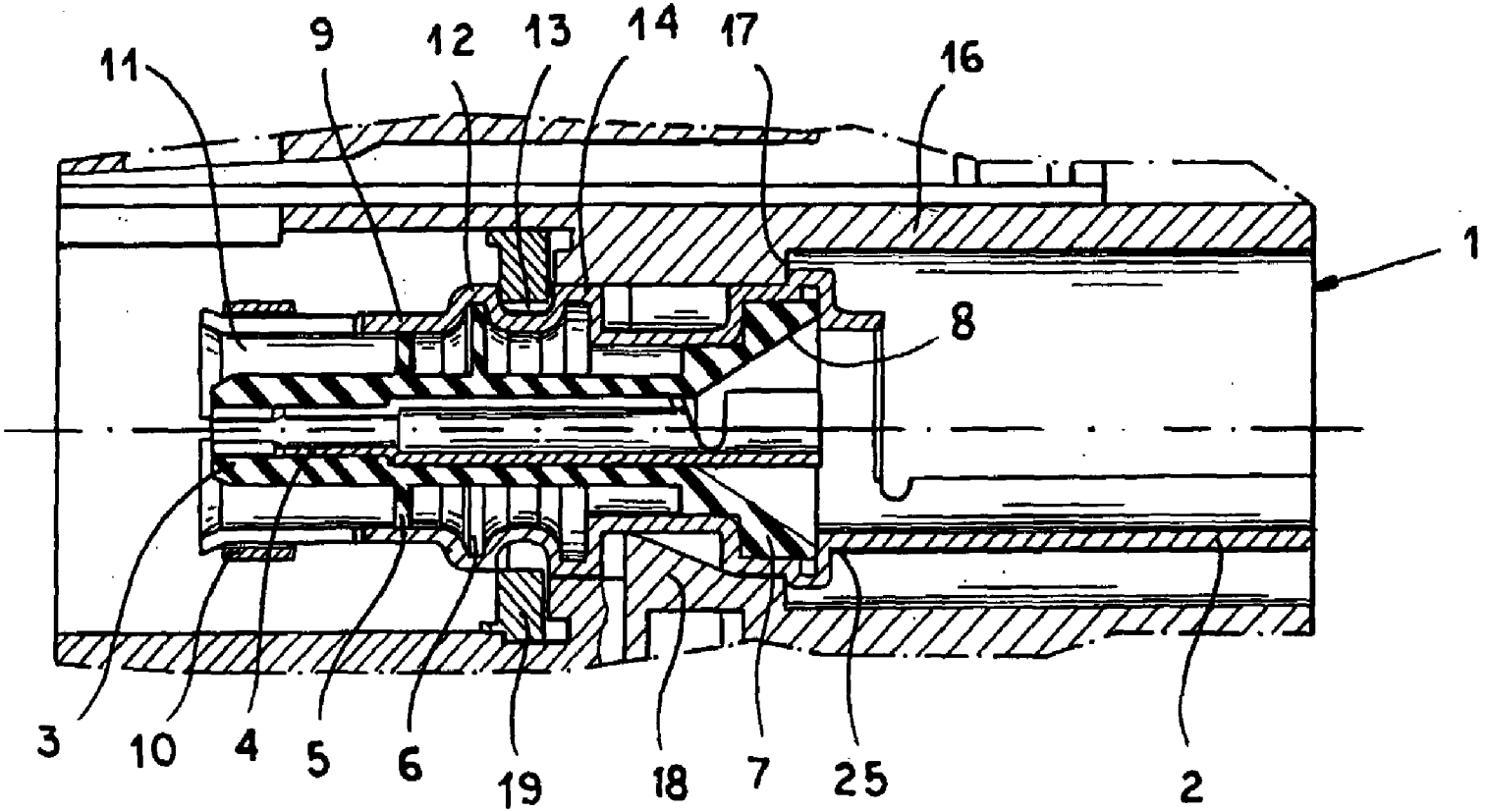
FIG. 4 is a section similar to that of FIG. 3 with additional modifications in the outer conductive sleeve.
Figure 5:
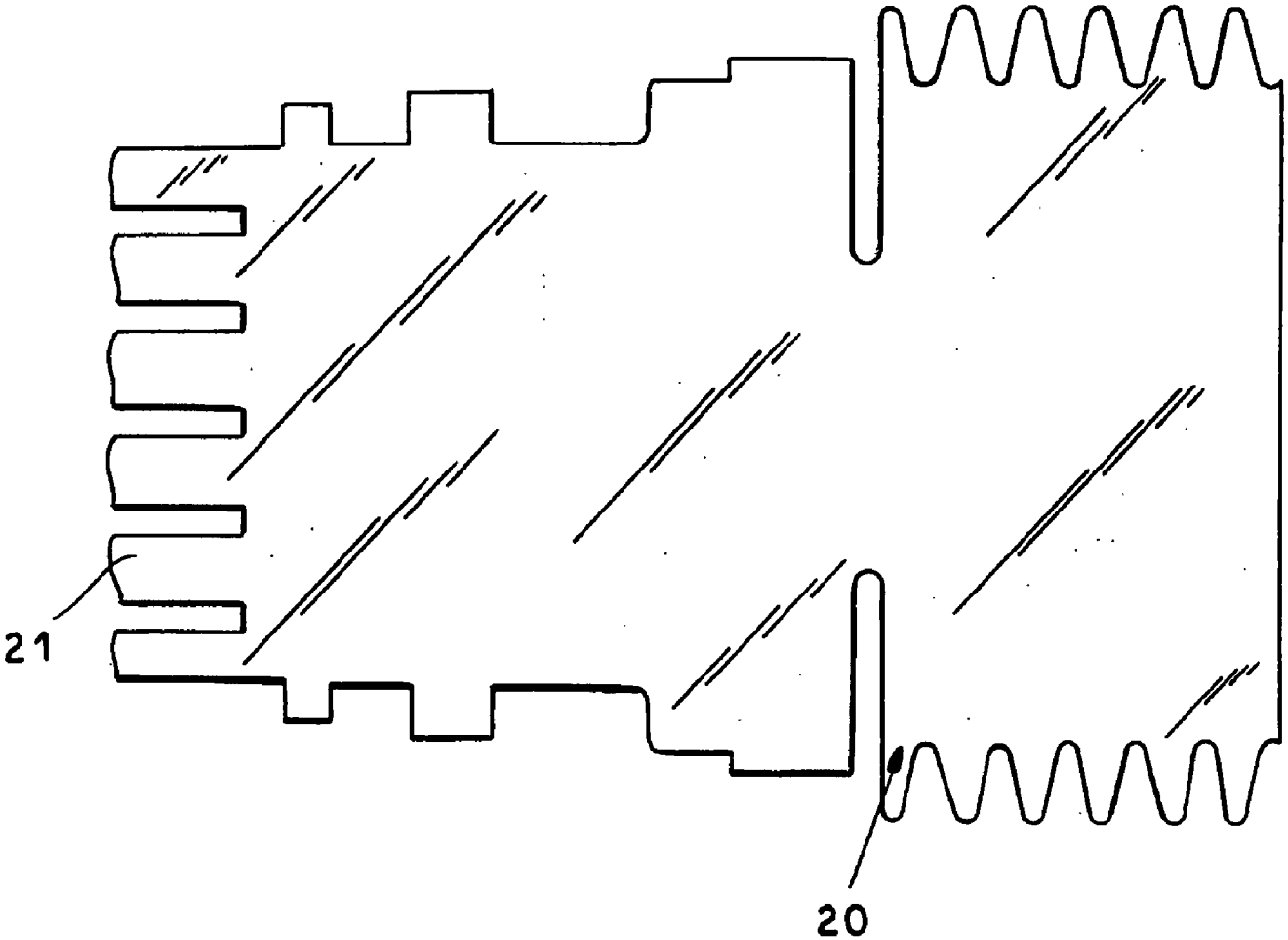
FIG. 5 is a plan view of a blank suitable for use in making a sleeve of FIG. 1.

The embodiment of FIG. 4 is a further modification of the outer conductive sleeve in the region of the cable connection. The outer conductive sleeve 2 has a third bulge shaped enlargement 25 which engages behind the support flange 7 and provides a further retention of the insulator in the outer conductive housing.

The invention claimed is:

1. A coupler for a coaxial plug connectable with a cable and capable of being used as an antenna coupler comprising:

an outer conductive sleeve of metal, an insulator within said sleeve and a contact element within said insulator, said sleeve, said insulator and said contact element being coaxial with one another, said sleeve being composed of a plastically deformable sheet metal blank whose shape is formed by stamping, punching, or cutting and whose sleeve shape is produced by bending of the blank;

a support body having a prelocking element engaged on insertion of the outer conductive sleeve in the support body; and a locking slider engageable with at least one bulge-like enlargement in the outer conductive sleeve for retaining the outer conductive sleeve in the support body.

2. The coupler defined in claim 1 wherein said outer conductive sleeve is rolled onto said insulator.

3. The coupler defined in claim 1 wherein the outer conductive sleeve has a plug-receiving region at one end, said plug-receiving region being surrounded by a spring ring.

4. The coupler defined in claim 3 wherein the ring is received between formations of said outer conductive sleeve on opposite sides of said spring ring.

5. The coupler defined in claim 1 wherein said insulator is formed with at least one circumferential outer ring.

6. The coupler defined in claim 5 wherein said outer conductive sleeve has at least one bulge shaped enlargement formed by upsetting, rolling and being and receiving said ring.

7. The coupler defined in claim 5 wherein said insulator has at least one further ring spaced from the first mentioned ring and dimensioned to enable said insulator to be fitted axially into said outer conductive sleeve.

8. The coupler defined in claim 5 wherein said outer conductive sleeve has at least two bulge shaped enlargements with a constricted region between them.

9. The coupler defined in claim 8 wherein said outer conductive sleeve has a third bulge shaped enlargement between another of said bulge shaped enlargements and a cable connector on the outer conductive sleeve.

* * * * *